US009163915B2

(12) United States Patent
Roy

(10) Patent No.: US 9,163,915 B2
(45) Date of Patent: Oct. 20, 2015

(54) PROJECTILE WITH STEERABLE CONTROL SURFACES AND CONTROL METHOD OF THE CONTROL SURFACES OF SUCH A PROJECTILE

(71) Applicant: NEXTER MUNITIONS, Versailles (FR)

(72) Inventor: Richard Roy, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 84 days.

(21) Appl. No.: 14/180,806

(22) Filed: Feb. 14, 2014

(65) Prior Publication Data

US 2014/0231577 A1 Aug. 21, 2014

(30) Foreign Application Priority Data

Feb. 18, 2013 (FR) ..... 13 00370

(51) Int. Cl.
*F42B 10/64* (2006.01)
*F42B 15/01* (2006.01)
*F42B 10/62* (2006.01)

(52) U.S. Cl.
CPC ..... *F42B 15/01* (2013.01); *F42B 10/62* (2013.01); *F42B 10/64* (2013.01)

(58) Field of Classification Search
CPC ..... F42B 10/60; F42B 10/62; F42B 10/64; F42B 15/01
See application file for complete search history.

(56) References Cited

U.S. PATENT DOCUMENTS

| | | | | |
|---|---|---|---|---|
| 4,210,298 | A * | 7/1980 | Liberman | 244/3.21 |
| 4,738,412 | A * | 4/1988 | Ozunas | 244/3.21 |
| 7,246,539 | B2 | 7/2007 | Turner | |
| 2008/0006736 | A1 | 1/2008 | Banks | |

OTHER PUBLICATIONS

Search report issued in French Patent Application No. 1300370 dated Nov. 19, 2013 (with translation).
Written Opinion issued in French Patent Application No. 1300370 dated Nov. 19, 2013 (with translation).

* cited by examiner

*Primary Examiner* — Brian M O'Hara
(74) *Attorney, Agent, or Firm* — Oliff PLC

(57) ABSTRACT

The subject-matter of the invention is a method for controlling the control surfaces of a projectile and the associated projectile comprising incidence steerable control surfaces and comprising at least two control surfaces, each one being rotatable with respect to the projectile around a pivot axis perpendicular to the longitudinal axis X of the projectile, wherein the projectile comprises central means for controlling the control surfaces having at least a spherical shape, a control arm secured to the spherical shape and adapted to rotate the spherical shape, for each control surface a transmission member cooperating with the spherical shape and adapted to transmit to the control surface the rotation movements of the spherical shape, and means for positioning the arm.

6 Claims, 11 Drawing Sheets

PROJECTILE WITH STEERABLE CONTROL SURFACES AND CONTROL METHOD OF THE CONTROL SURFACES OF SUCH A PROJECTILE

CROSS REFERENCE TO RELATED APPLICATIONS

Applicant claims priority under 35 U.S.C. 119 of French patent application no. 1300370 filed on Feb. 18, 2013.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The invention relates to the technical field of projectiles guided by incidence steerable control surfaces.

To guide a projectile up to its target, it is known to use control surfaces (or fins) arranged on the periphery of the projectile, either at the empennage or in front position (control surfaces known as foreplane or canard control surfaces). The incidence of the control surfaces is adapted while airborne according to the desired trajectory for the projectile. The incidence piloting is most often performed by electrical motors. The U.S. Pat. No. 7,246,539 discloses a piloting device of control surfaces of a projectile comprising four control surfaces as well as gear trains associated with motors enabling to set the incidence of the control surfaces.

This type of device requires to know the exact angular position, both for incidence and rolling, of each control surface to make the control surface adopt the suitable position to make the projectile follow the desired trajectory. The projectile undergoing a rolling which can be very important, particularly if it is fired from a rifled canon weapon, it is thus necessary to perform continuous corrections on the incidence of the control surfaces.

These corrections have to be performed extremely quickly, requiring fast calculating means and fast movements of the control surfaces. These fast movements generate current peaks in motors, causing a control in fits and starts of the motors. These current peaks are also the cause of intense and irregular magnetic fields in motors. These fields affect the projectile guiding means such as homing devices or other sensing devices. Furthermore, the solution suggested by U.S. Pat. No. 7,246,539 is complex in terms of number of gear trains and movement transmission parts.

BRIEF SUMMARY OF THE INVENTION

Thus, the invention suggests to solve the problem of the piloting complexity of the control surface incidence according to their angular position around the projectile.

The invention also allows to reduce the numerous and violent stresses applied to motors.

The invention also allows to reduce the number of parts and to simplify the mechanical structure of the device for piloting the control surfaces.

BRIEF DESCRIPTION OF THE SEVERAL VIEWS OF THE DRAWING

The invention may be understood by reference to the following description taken in conjunction with the accompanying drawings, in which.

DETAILED DESCRIPTION OF THE INVENTION

Figure 1:
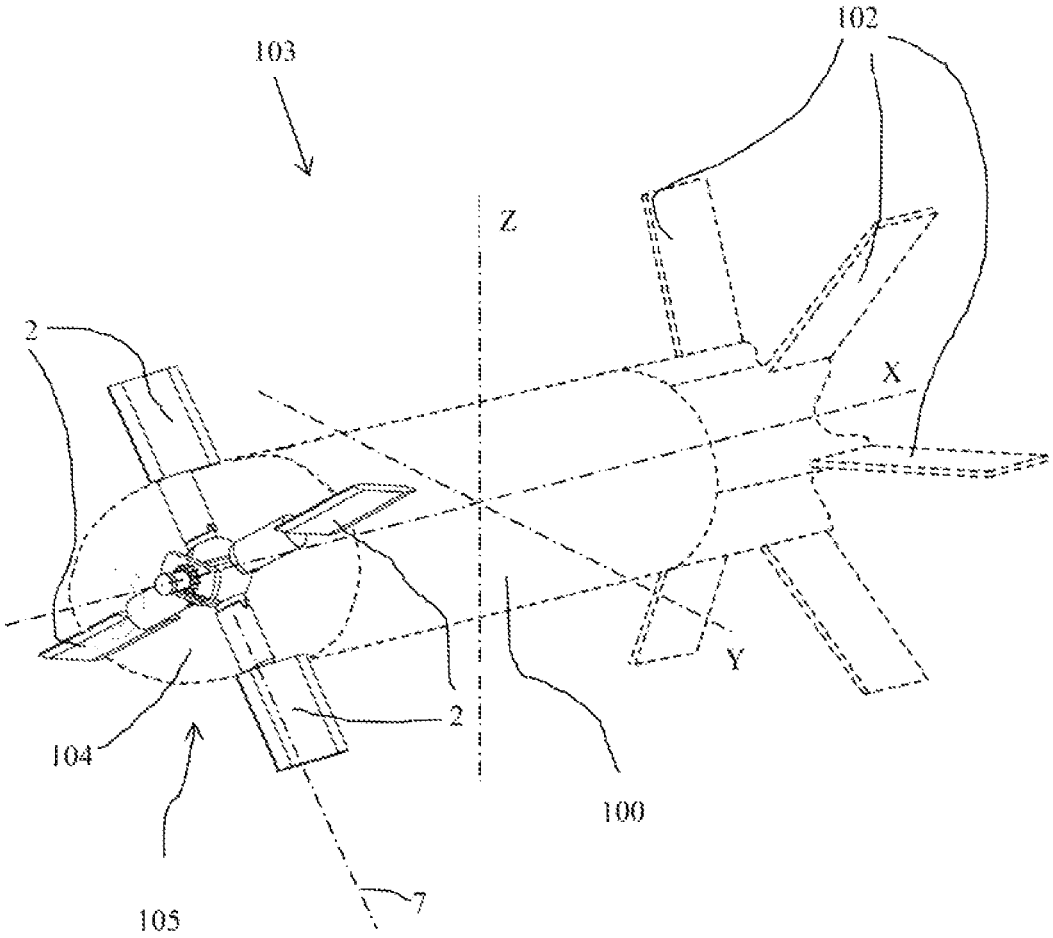
FIG. 1 shows a schematic view of an airborne projectile according to the invention.

According to FIG. 1, an airborne projectile 103 comprises a substantially cylindrical body 100. This projectile 103 comprises an empennage at the rear part, the empennage comprising fixed incidence ailerons 102 for stabilizing the projectile 103 according to its pitch Y and yaw Z axes. The projectile has a rotation movement R around its longitudinal axis, referred to as rolling axis X.

At the front part of the projectile 103 is provided a steering device 105 comprising control surfaces 2 secured to the projectile 103, and each control surface being pivotable on a control surface axis 7 perpendicularly to the rolling axis X so as to modify their incidence and, consequently, to make the projectile 103 follow a desired trajectory. Since the control surfaces 2 are secured to the projectile 103, they also have the same rotation movement R around the rolling axis X as the projectile 103.

At the front part of the projectile 103, in the vicinity of the control surfaces 2, is a warhead 104 which houses a piloting device 1 for steering the incidence of the control surfaces 2 of the projectile 103 following a guiding law programmed in a homing device (not shown).

Figure 2:
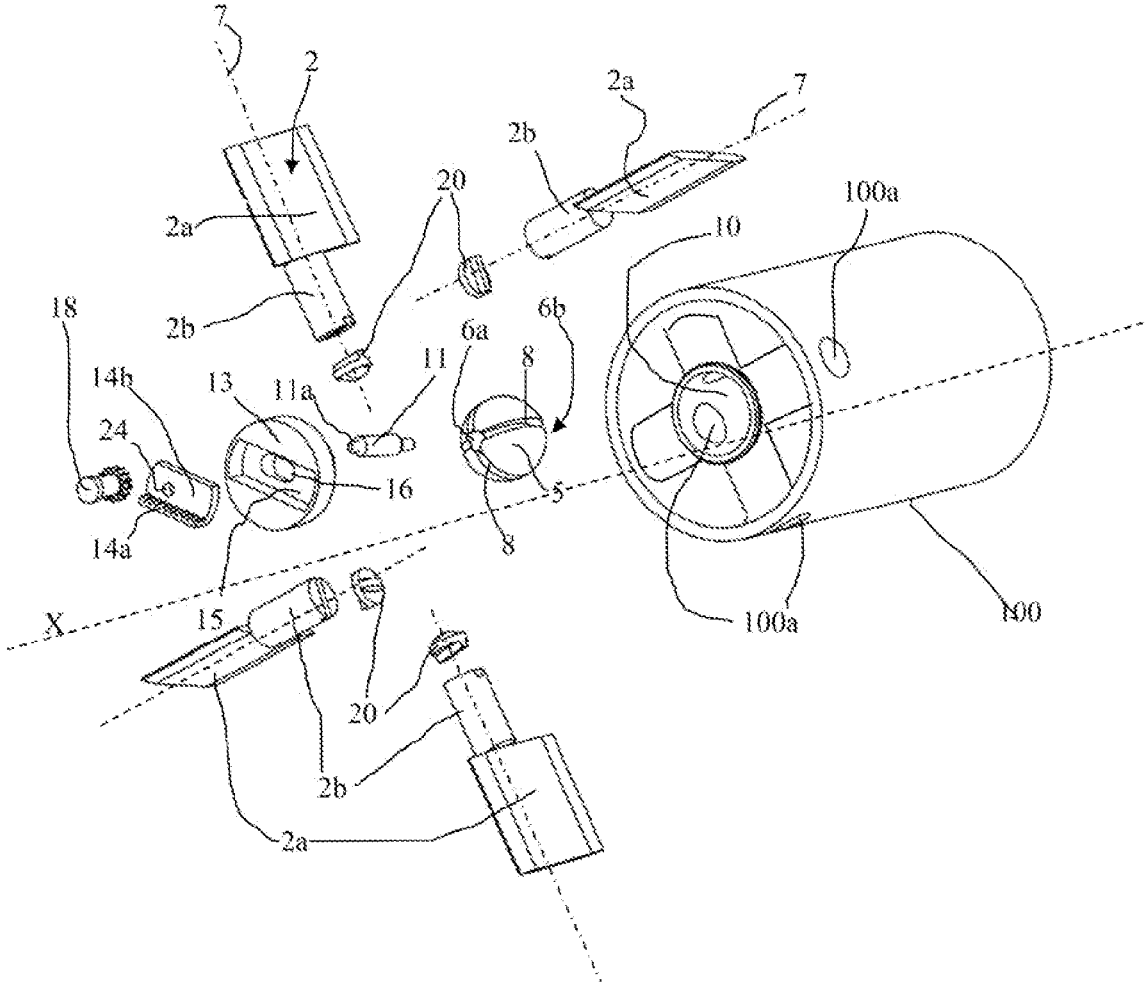
FIG. 2 shows an exploded view of a steering device according to the invention.

According to FIG. 2, the piloting device 1 comprises the following elements:

Control surfaces 2 secured to the projectile and incidence-steerable by pivoting around axes 7 perpendicular to the longitudinal rolling axis X.

The control surfaces 2 are herein shown in their deployed position and there are four of them. The one skilled in the art may choose to provide the projectile with two or more control surfaces, in even or odd number, and regularly angularly distributed around the projectile.

Each control surface 2 comprises a directing plane 2*a*, the base of which is secured to a first end of a control surface foot 2*b* pivotally mounted in a cylindrical and radial bore 100*a* of the projectile body 100. Each directing plane 2*a* is intended for influencing, by pivoting around the axis 7, the downforce of the projectile 103 to change its trajectory.

Each bore 100*a* of the projectile body 100 opens radially into a central housing 10 of the projectile body 100. This central housing 10 is a cylindrical housing which receives a central control means 5 which comprises at least a spherical shape, the center O of which is located on the longitudinal axis X of the projectile 103 and on the pivot axes 7 of the control surfaces 2 (the spherical, shape or sphere 5 will be better seen in FIG. 3).

According to the shown embodiment, the central control means 5 is thus a sphere 5 comprising grooves 8 which are oriented along meridian lines of the sphere which join at the poles 6*a* and 6*b* of the sphere 5. There are as many grooves 8 as there are control surfaces 2.

One of the poles 6*a* of the sphere carries a control arm 11 projecting from the sphere 5. It will be noted in FIG. 3 that, when the control, surfaces 2 are oriented at zero incidence (also called neutral position), the two poles 6*a* and 6*b* of the sphere 5 located at each end of the grooves 8 are also positioned on the longitudinal axis X. The control arm 11 is then positioned on this X axis and the grooves are thus arranged parallel to the longitudinal axis X of the projectile when the control surfaces 2 are themselves parallel to the longitudinal axis X of the projectile.

For each control surface 2, between the sphere 5 and the control surface foot 2*b* is a transmission member 20, intended to transmit to the control surface 2 only the rotation movements of the sphere 5 around the pivot axis 7 of the control surface 2.

Figure 4:
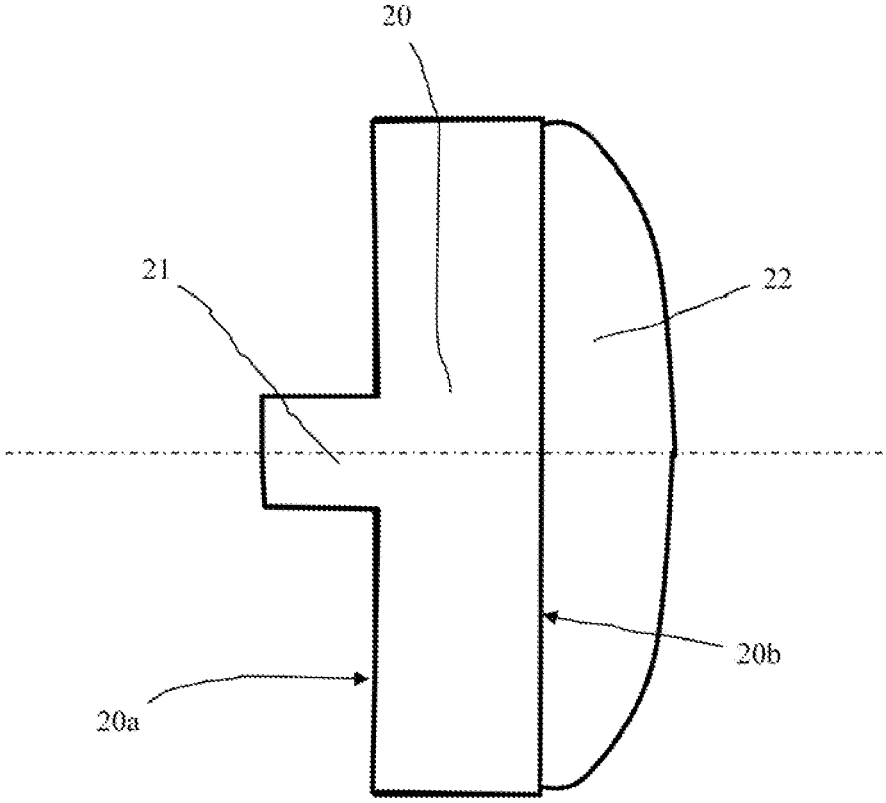
FIG. 4 shows a schematic side view of a torque transmitting means.

As can be seen in FIG. 4, the transmission member 20 comprises on a first face 20*a* facing toward the sphere 5 a preferably prismatic first profile 21 corresponding to the groove 8. This first profile 21 is adapted to slide in the groove 8. The transmission member 20 comprises a second face 20*b* parallel to the first face 20*a*. The second face 20*b* of the transmission member 20 comprises a second profile 22 intended to slide in a corresponding slot 23 carried by the control surface foot 2*b*.

Considering the longest lengths of the profiles 21 and 22, it will be noted that these are orthogonal to each other. The profiles 21 and 22 are herein in the shape of tabs, both tabs 21 and 22 being orthogonal to each other and secured to a cylindrical portion of the member 20.

Figure 3:
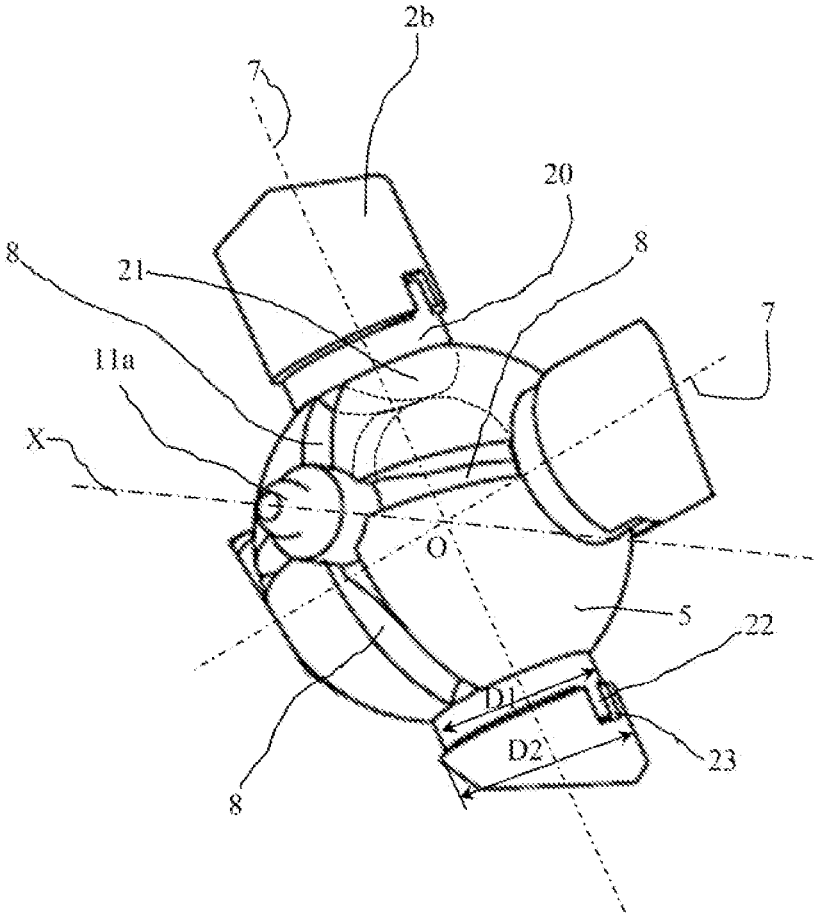
FIG. 3 shows a detailed view of the steering device according to the invention, without any positioning means.

It will be noted in FIG. 3 that the transmission member 20 is substantially cylindrical and selected with a diameter D1 slightly smaller than the diameter D2 of the control surface foot 2*b* so that it can translate in a plane P normal to the rotation axis 7 of the control surface 2 without interfering with the cylindrical wall of the bore 100*a* that contains it. The transmission member 20 thus connected with the sphere 5 and the control surface foot 2*b* acts as a seal, called Oldham seal. It allows to reduce friction at the connections and allows to overcome the relative misalignments between the rotation axis of the fin and the instantaneous pivot axis of the sphere 5 which evolves at every piloting moment. Thus the fin receives from the sphere 5 only the mechanical torque ensuring the pivoting around the axis 7 of the control surface 2.

Figure 5:
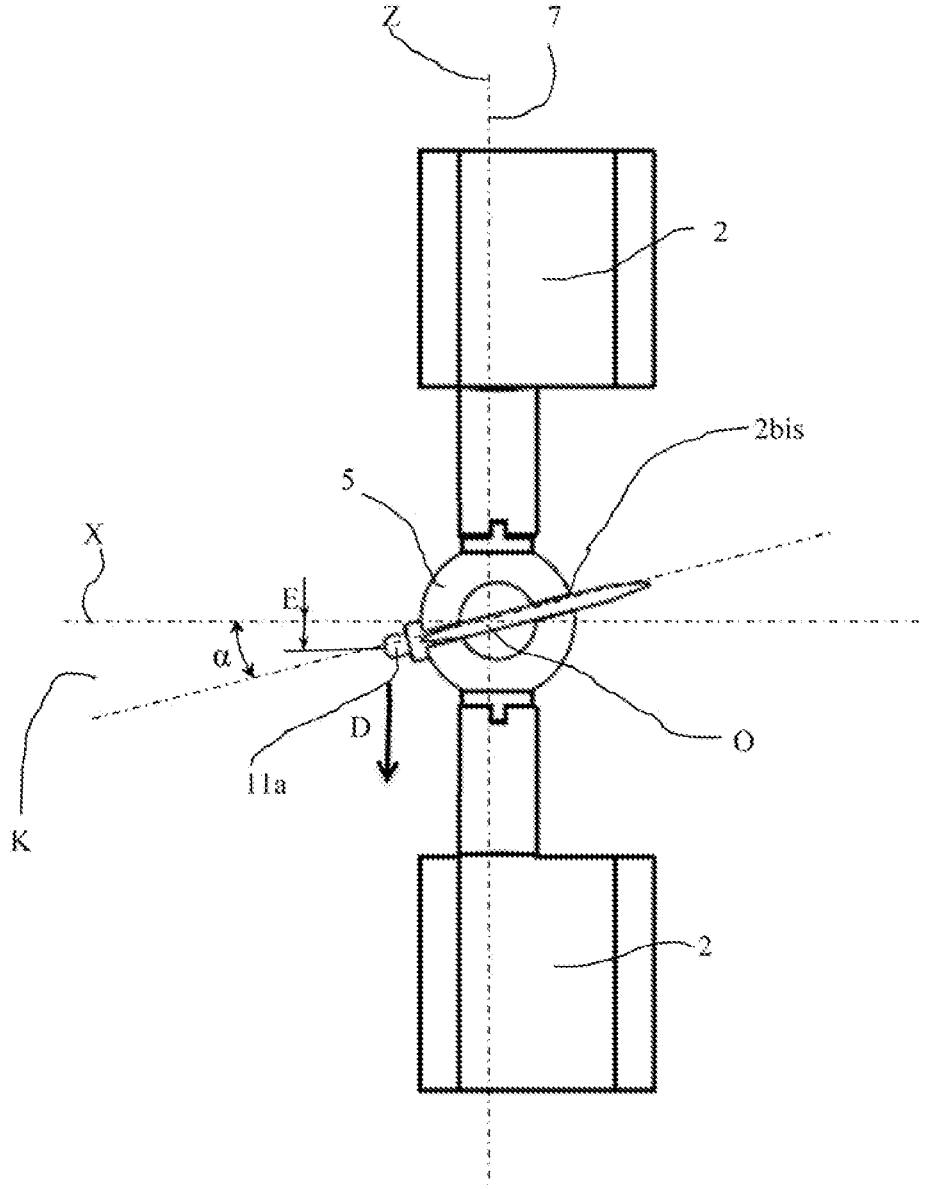
FIG. 5 shows a side view of a steering device according to the invention with a pair of control surfaces under incidence and without any positioning means.
Figure 6:
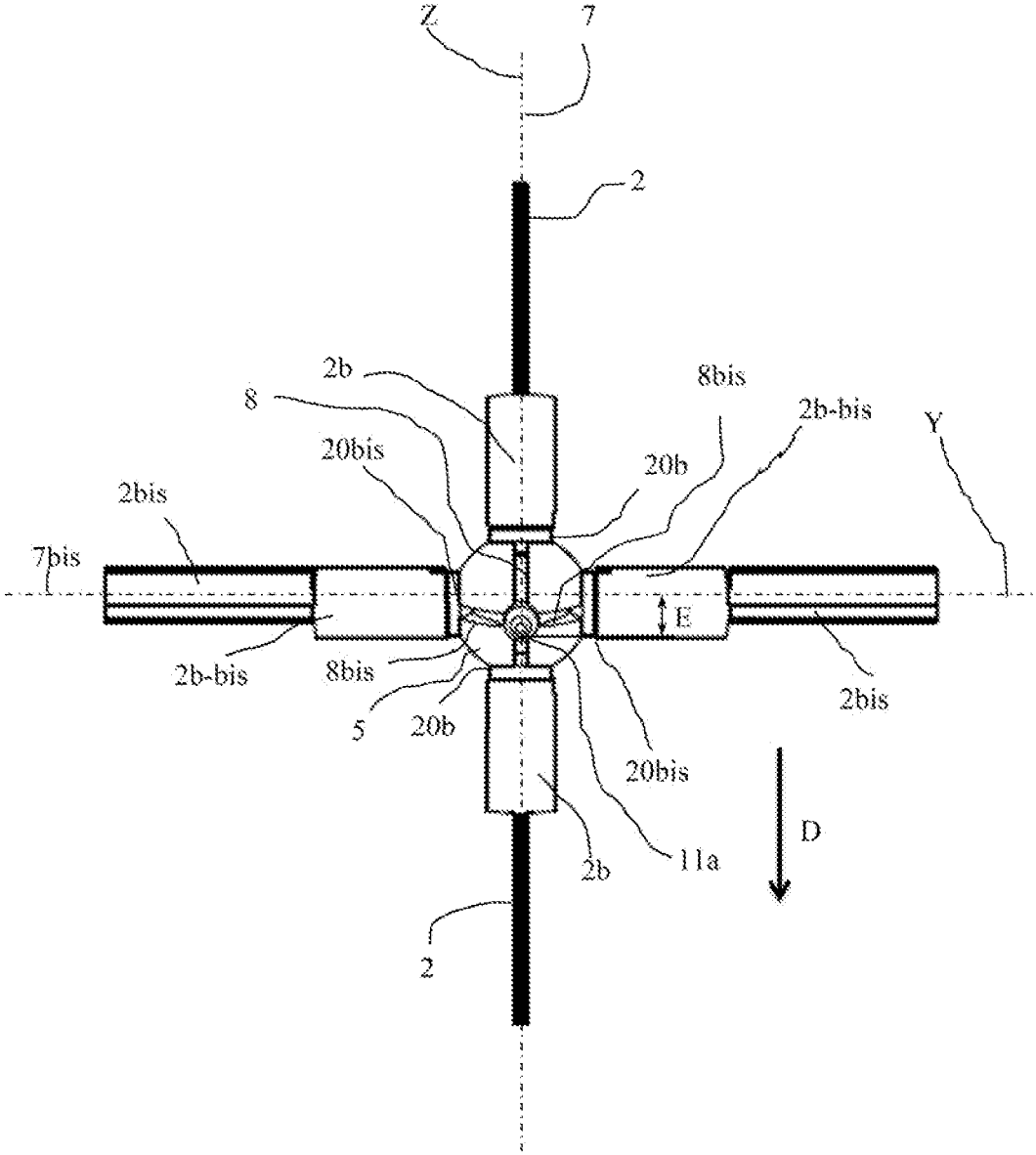
FIG. 6 shows a front view of a steering device in the configuration of FIG. 5.

Thus, according to FIGS. 5 and 6, if the end 11*a* of the arm 11 is moved away downwardly by a distance E with respect to the longitudinal axis X, the arm 11 pivotally drives the sphere 5 according to an angle α with a center O which is located in a plane K defined by the longitudinal rolling X and yaw Z axes. The pitch axis Y is then perpendicular to the plane K. According to FIGS. 5 and 6, a first pair of control surfaces 2 has its pivot axis 7 contained in the plane K, while the second pair of control surfaces 2*bis* has its pivot axis 7*bis* collinear with the pitch axis Y.

For each control surface of the second pair 2*bis*, the transmission member 20*bis* then communicates a pivoting torque to the control surfaces 2*bis* via its first and second profiles (not visible in these figures) which correspond to the groove 8*bis* of the sphere 5 and the control surface foot 2*b bis*, respectively, thereby making the control surfaces 2*bis* assume an incidence α.

At the same time, the grooves 8 associated with the control surfaces 2, with a pivot axis collinear with the yaw axis Z, are oriented parallel to the longitudinal axis X and thus do not have any incidence angle. The first profile of each transmission element 20 associated to the control surfaces 2 cannot transmit any effort but lets the groove 8 associated therewith slide without transmitting any pivoting to the control surfaces 2 which then remain in the plane K at zero incidence.

Figure 7:
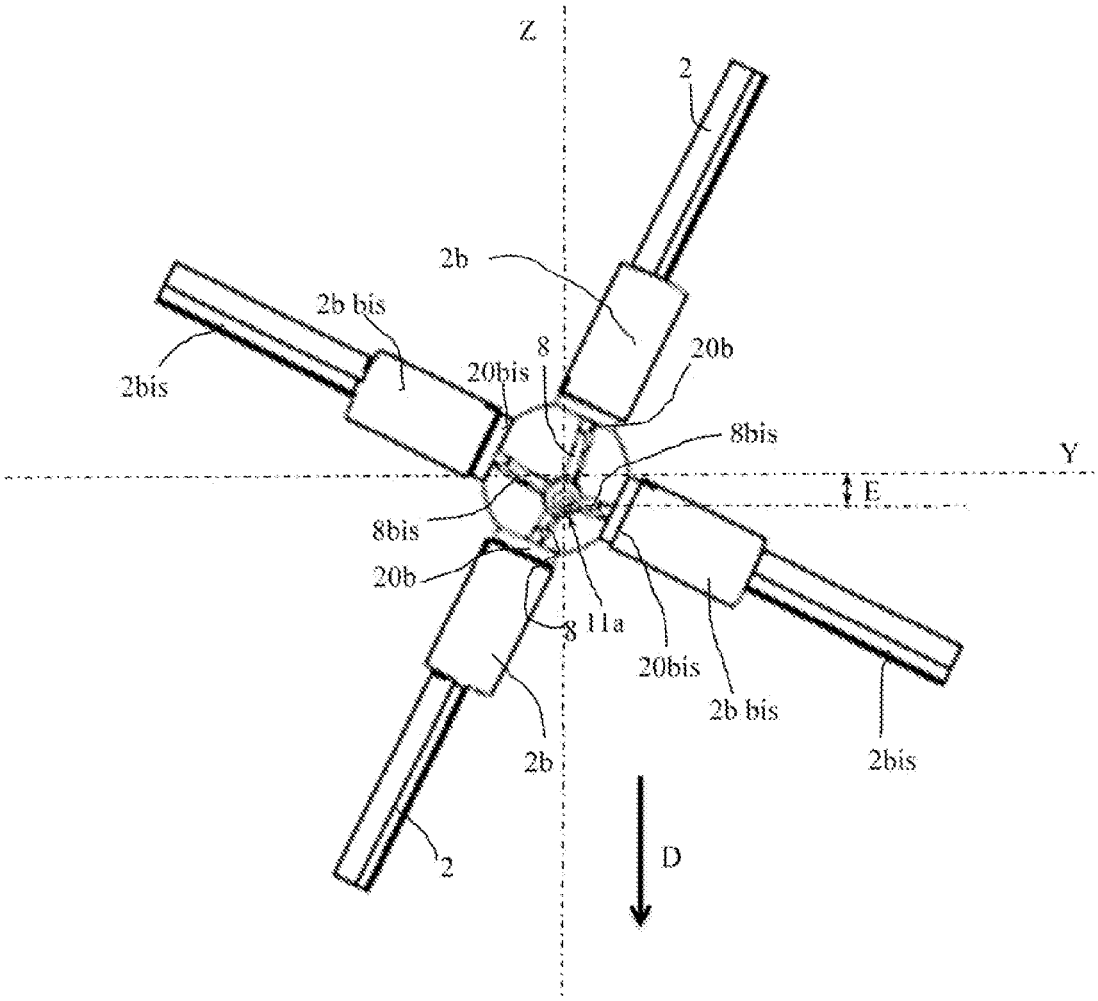
FIG. 7 shows a front view of a steering device in the configuration of FIG. 5 with a set of rotating control surfaces.

When the projectile and ail the control surfaces 2 and 2*bis* are in a rotation R around the longitudinal axis X, as in FIG. 7, the sphere 5 is rotationally driven by the first shapes of the transmission members 20 and 20*bis* pressing on the side walls of the grooves 8. Considering that the position previously downwardly given to the end 11*a* of the arm 11 is maintained, the pivot axis 7 of each pair of control surfaces 2 and 2*bis* will pass successively through the plane K and through a plane normal to this plane K. Thus, each groove 8 will alternately undergo an inclination of an angle α when the control surface axis 7 passes through the plane normal to the plane K and will be aligned on the longitudinal axis X when the pivot axis X of the control surface 2 passes through the plane K.

Thus, whatever the angular position of the control surfaces 2 around the longitudinal axis X, the control surfaces 2 always assume the appropriate incidence to orientate the projectile towards the direction D which is given by the positioning of the end 11*a* of the arm 11 (i.e. downwardly in the selected example).

Figure 9:
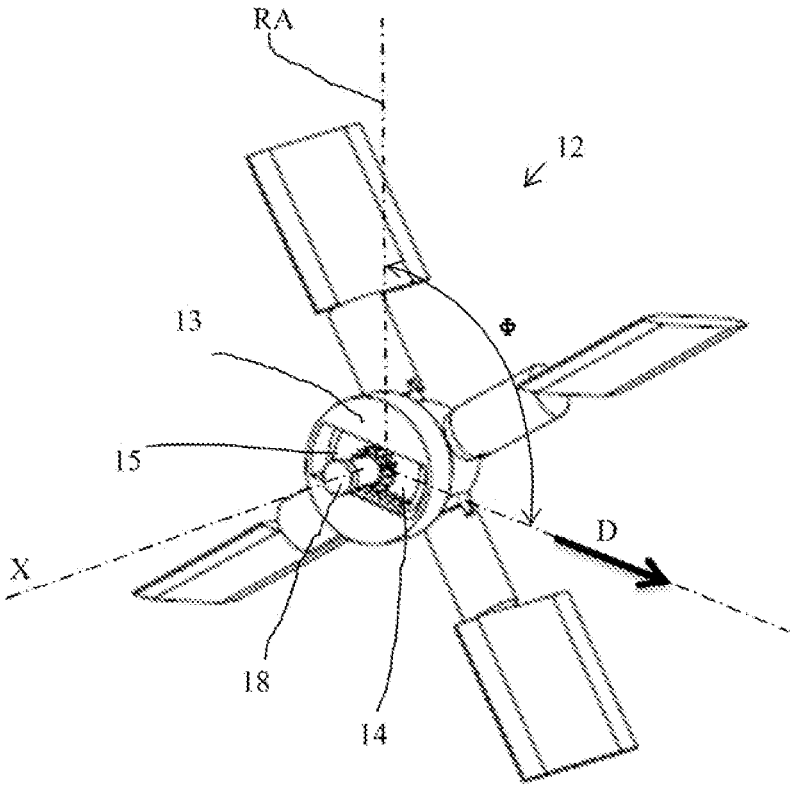
FIG. 9 shows a three-quarter view of a steering device according to the invention with its control surfaces and with a positioning means.

In order to control the positioning of the end 11*a* of the arm 11 with respect to the longitudinal axis X and angularly with respect to an absolute frame RA, the projectile comprises a positioning means 12 comprising a substantially circular housing 13 and a rack 14 visible in FIG. 9.

Figure 10:
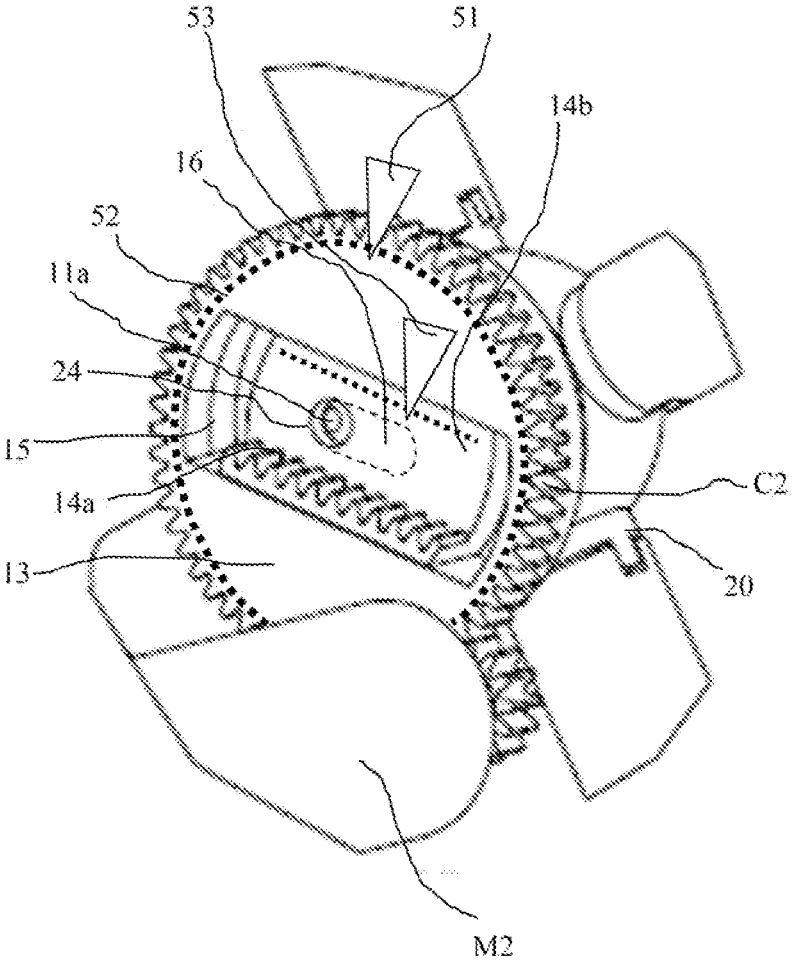
FIG. 10 shows an enlarged detailed view of the steering device, wherein the rack is positioned in its slideway.

The rack 14 comprises a toothed portion 14*a* which is secured to a plate 14*b* which is housed in a slideway 15 of the housing 13 (see FIGS. 2 and 10).

The rack 14 can thus translate along a direction parallel to the diameter of the housing 13.

Figure 8:
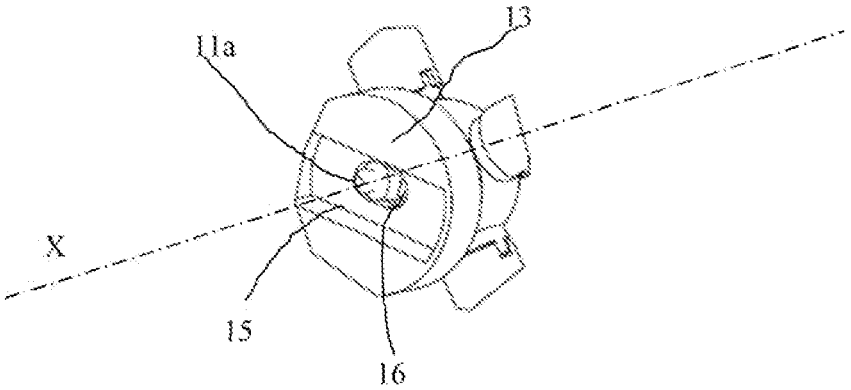
FIG. 8 shows a detailed view of the steering device according to the invention with a positioning means.

As is visible in FIG. 8, the housing 13 is coaxial with the longitudinal axis X of the projectile and it comprises an oblong hole 16 oriented parallel to the slideway 15 and which allows to let the arm 11 pass through so that the free end 11*a* of the arm 11 can cooperate with a hole 24 carried by the plate 14*b* of the rack 14 (see FIGS. 2 and 10). The end 11*a* of the arm is spherical and the connect between this end and the hole 24 of the rack 14 forms a ball joint.

The rack 14 is adapted for meshing with a pinion 18 of a first motor M1 (pinion visible in FIGS. 2, 9 and 11, motor M1 visible in FIG. 11) aligned on the longitudinal axis X of the projectile 103 in order to foe able to control the translation of the rack 14 in the housing 13.

Figure 11:
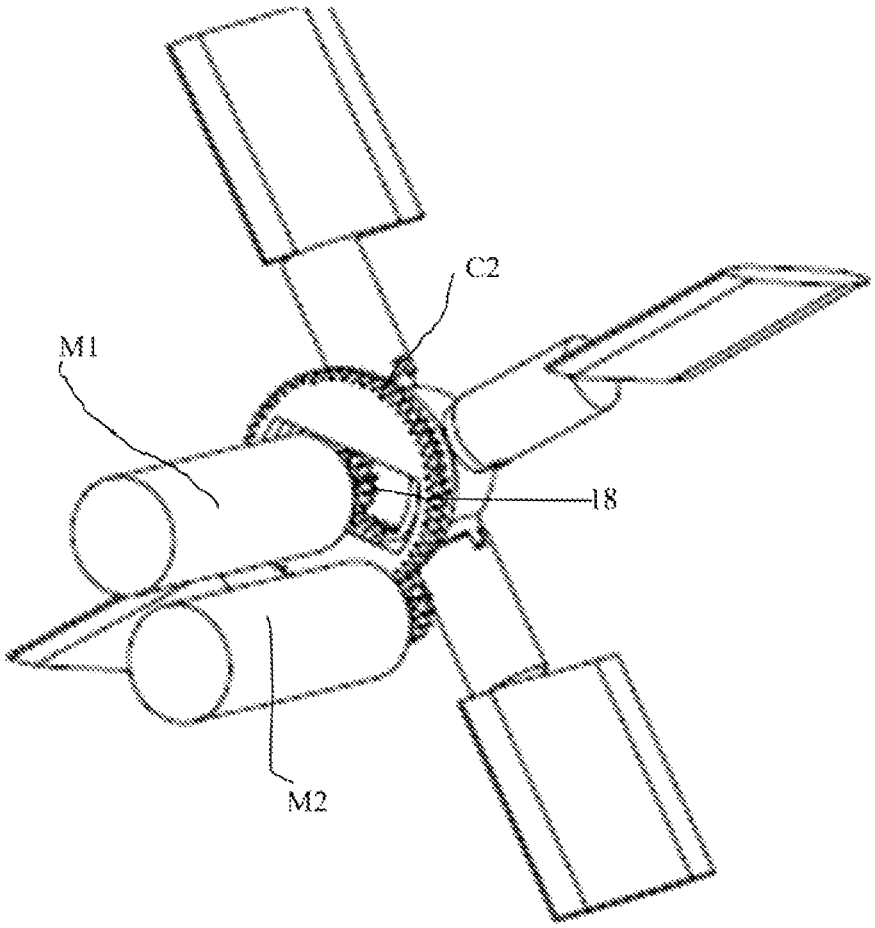
FIG. 11 is a schematic view showing the positioning of the motors.

The housing 13 comprises on its periphery a toothed ring C2 adapted for meshing with a second motor M2 (toothed ring C2 and motor M2 visible in FIGS. 10 and 11).

The positioning means 12 allows to orientate the projectile 103 towards a given direction D transverse to the projectile 103. During the flight of the projectile 103, when the control surfaces are at zero incidence and for them to remain in this position, the motors must run synchronously at an angular velocity $-\Omega$ in the opposite direction of the projectile 103 to compensate for the rotation of the latter having a speed $\Omega$.

In order to orientate the projectile 103 by changing the incidence of the control surfaces 2, the motors will have to be phase shifted each other. To this end, the second motor M2 will rotate at a speed $-\Omega\pm\omega 2$ to rotate the housing 13 with an angle $\Phi$ with respect to the absolute frame RA while the motor M1 will always run at the speed $-\Omega$. This phase shift will be maintained until the slideway 15 is parallel to the direction D selected for the desired correction, and this always while compensating the rotation of the projectile.

Thus, as shown in FIG. 10, in order to know the angular position of the slideway 15 in the absolute frame RA, it is possible, for example, to resort to the use of an optical sensor 51 secured to the projectile body and rotating therewith and adapted no read an encoder ring 52 secured to the periphery of the housing 13. The position of this sensor 51 is precisely known with respect to the absolute frame provided by an inertial navigation system of the projectile. An onboard computer will then easily know the angular position of the slideway 15 as and when the projectile body rotates around the housing 13. The movement amplitude of the rack 14 can also be measured by a linear-type sensor 53 located between the housing 13 and the rack 14.

Once this angle $\Phi$ is reached, both motors go back in phase.

The next step consists in sliding the rack 14 in the given direction D by rotating the first motor M1 at a speed $-\Omega\pm\omega 1$, the second motor M2 still rotating at the speed $-\Omega$. The translation of the rack 14 causes the off-centering E between the end 11*a* of the arm 11 and the longitudinal axis X, thus providing the desired amplitude correction, the amplitude being determined by the orientation control law of the projectile.

The invention therefore allows to obtain a projectile that can be piloted, comprising a simple and reliable device for steering the control surfaces and where the electromagnetic stress issues are greatly reduced, due to the regular activity of the motors which are not subjected to brutal and constant current peaks.

It is possible to implement the invention with a number of control surfaces different from four. It will thus be possible to make a projectile comprising three or five steerable control surfaces. To this end, it is sufficient to simply change the number of grooves 8 made in the sphere 5 (one groove per control surface). The control method of the control surfaces remains the same in any case. A projectile according to the invention comprising only two control surfaces can also foe contemplated but it would be harder to pilot.

The invention claimed is:

1. A projectile with incidence steerable control surfaces comprising at least two control surfaces, each control surface being rotatable with respect to the projectile around a pivot axis perpendicular to a longitudinal axis of the projectile, wherein the projectile comprises:

central means for controlling the control surfaces comprising at least a sphere, a center of the sphere being on the longitudinal axis, the sphere being arranged in a housing of the projectile, a control arm secured to the sphere and adapted to rotate the sphere at least around the pitch and yaw axes of the projectile passing through the center of the sphere, for each control surface, a transmission member cooperating with the sphere by a first side and with a foot of the control surface by a second side, wherein the transmission member is intended to transmit to the control surface rotation movements of the sphere around the pivot axis of the control surface, means for positioning the control arm adapted to position an end of the control arm in a position determined with respect to an absolute frame centered on the longitudinal axis of the projectile.

2. The projectile with incidence steerable control surfaces according to claim 1, wherein the sphere comprises, for each control surface, a groove oriented along a meridian line of the sphere and starting from the control arm, wherein the grooves are arranged parallel to the longitudinal axis when the control surfaces are parallel to the longitudinal axis of the projectile.

3. The projectile with incidence steerable control surfaces according to claim 2, wherein each groove cooperates with the first side of the transmission member by a first profile of the transmission member corresponding to the groove, wherein the first profile is adapted to slide in the groove.

4. The projectile with incidence steerable control surfaces according to claim 3, wherein the second side of the transmission member comprises a second profile orthogonal to the first profile, wherein the second profile cooperates with a slot carried by the foot of the control surface, wherein the second profile is adapted to slide in the slot.

5. The projectile with incidence steerable control surfaces according to claim 1, wherein the positioning means comprises a housing coaxial with the projectile, wherein the housing encloses a rack which is secured to the end of the arm by a ball joint, wherein the rack can also slide in a slideway of the housing which is oriented parallel to a diameter of the housing, wherein a first motor meshes with the rack to move the rack in the slideway and the housing is surrounded by a ring gear meshing with a second motor adapted to angularly orientate the slideway.

6. A method for orientating the projectile according to claim 5 along a given direction transverse to the projectile, wherein the method successively comprises the following steps:

rotating the first and second motors in phase and in a direction opposite to the rolling of the projectile so as to compensate for the rotation of the projectile, pivoting the housing by an angle by dephasing the rotation of the second motor with respect to the rotation speed of the first motor so that the slideway is parallel to the given direction, while compensating for the rotation of the projectile by maintaining the rotation of the first motor in a direction opposite to the rolling of the projectile, resynchronizing the first and second motors so as to compensate for the rotation of the projectile, sliding the rack in the given direction by dephasing the rotation of the first motor with respect to the rotation speed of the second motor which is still maintained in the direction opposite to the rolling of the projectile until an off-centering between the end of the arm and the longitudinal axis provides a desired correction amplitude.

* * * * *